US005888057A

United States Patent [19]

Kitano et al.

[11] Patent Number: 5,888,057

[45] Date of Patent: Mar. 30, 1999

[54] SCROLL-TYPE REFRIGERANT FLUID COMPRESSOR HAVING A LUBRICATION PATH THROUGH THE ORBITING SCROLL

[75] Inventors: Norio Kitano; Takeo Takahashi, both of Gunma; Tamaki Yamamoto, Honjo, all of Japan

[73] Assignee: Sanden Corporation, Gunma, Japan

[21] Appl. No.: 872,060

[22] Filed: Jun. 10, 1997

[30] Foreign Application Priority Data

Jun. 28, 1996 [JP] Japan ..... 8-169450

[51] Int. Cl.[6] ..... F04C 18/04; F04C 29/02

[52] U.S. Cl. ..... 418/55.2; 418/55.4; 418/55.6; 418/91; 418/178

[58] Field of Search ..... 418/55.2, 55.4, 418/55.6, 91, 178

[56] References Cited

U.S. PATENT DOCUMENTS

| | | | |
|---|---|---|---|
| 4,340,339 | 7/1982 | Hiraga et al. | 418/55.6 |
| 4,498,852 | 2/1985 | Hiraga | 418/55.4 |
| 4,527,963 | 7/1985 | Terauchi | 418/55.6 |
| 4,538,975 | 9/1985 | Tsukagoshi | 418/55.6 |
| 4,547,138 | 10/1985 | Mabe et al. | 418/55.6 |
| 4,645,436 | 2/1987 | Sakamoto | 418/55.2 |
| 4,932,845 | 6/1990 | Kikuchi et al. | 418/55.6 |
| 5,308,231 | 5/1994 | Bookbinder et al. | 418/55.6 |
| 5,330,335 | 7/1994 | Teracuhi et al. | 418/55.6 |
| 5,456,584 | 10/1995 | Isomura et al. | 418/55.1 |

FOREIGN PATENT DOCUMENTS

| | | |
|---|---|---|
| 04 045 12 A2 | 12/1990 | European Pat. Off. . |
| 04 045 12 A3 | 12/1990 | European Pat. Off. . |
| 59-142490 | 9/1984 | Japan . |

*Primary Examiner*—John J. Vrablik
*Attorney, Agent, or Firm*—Baker & Botts, L.L.P.

[57] ABSTRACT

A scroll-type refrigerant fluid compressor includes a fixed scroll having a first circular end plate from which a first spiral wrap extends, and an orbiting scroll having a second circular end plate from which a second spiral wrap extends. The spiral wraps interfit each other at an angular and radial offset to form line contacts defining a pair of sealed-off fluid pockets. An anti-wear plate is disposed on one end surface of the second circular end plate of the orbiting scroll that engages with the second spiral element of the orbiting scroll. An annular boss is formed at a central portion of the other end surface of the second circular end plate of the orbiting scroll. An inner end of a drive shaft is operatively connected to the orbiting scroll through a bushing which is rotatably disposed within the boss. An axial hole is centrally formed through the second circular end plate of the orbiting scroll. Mists of the lubricating oil suspended in the refrigerant gas in a central fluid pocket are conducted to an inner space of the boss via an air gap between the second spiral wrap and the anti-wear plate, fine reticular paths at the second circular end plate of the orbiting scroll beneath the anti-wear plate, and the axial hole.

11 Claims, 9 Drawing Sheets

SCROLL-TYPE REFRIGERANT FLUID COMPRESSOR HAVING A LUBRICATION PATH THROUGH THE ORBITING SCROLL

BACKGROUND OF THE INVENTION

1. Field of the Invention

This invention relates to a scroll-type refrigerant fluid compressor, and more particularly, to a lubricating mechanism for lubricating the internal component parts of the scroll-type refrigerant fluid compressor.

2. Description of the Related Art

Scroll-type refrigerant fluid compressors are known in the prior art. For example, Japanese Utility Model Application Publication No. 59-142490 discloses a scroll-type refrigerant fluid compressor which will be described below with reference to FIG. 1. In the description, the right side of FIG. 1 is referred to as a rear or a rearward end, and the left side of FIG. 1 is referred to as a front or a forward end.

The scroll-type refrigerant fluid compressor comprises compressor housing 10. Compressor housing 10 comprises a cup-shaped casing 11 which is open at its forward end and closed at its rearward end. Compressor housing 10 further comprises a front end plate 12, which is disposed on cup-shaped casing 11 at its forward end to enclose an inner chamber 100 of cup-shaped casing 11. Front end plate 12 is secured to cup-shaped casing 11 by a plurality of peripherally disposed bolts 16. The mating surfaces between front end plate 12 and cup-shaped casing 11 are sealed by an O-ring 14. An inlet port 41 and an outlet port 51 are formed through a peripheral side wall 115 of cup-shaped casing 11, adjacent to a suction chamber 40 and a discharge chamber 50, respectively.

An opening 121 is centrally formed through front end plate 12. An annular plate member 15 is fixedly secured to a front end surface of front end plate 12 by a plurality of peripherally disposed bolts (not shown). A sleeve portion 151 forwardly projects from an inner periphery of annular plate member 15. Sleeve portion 151 is arranged, such that its longitudinal axis is aligned with the center of opening 121. A drive shaft 13 is disposed through an inner hollow space of sleeve portion 151, and through opening 121 of front end plate 12. A bearing 17 is peripherally disposed within the forward end of sleeve portion 151, and rotatably supports the forward end of drive shaft 13. At its opposite or inner end, drive shaft 13 includes a disk-shaped rotor 131, which rotates with drive shaft 13 and is integrally formed therewith. Rotor 131 is rotatably supported within opening 121 of front end plate 12 by a peripherally disposed bearing 18. A drive pin 132 projects rearwardly from the inner axial end surface of disk-shaped rotor 131 at a position offset from the longitudinal axis of drive shaft 13. When drive shaft 13 rotates, pin 132 orbits about the longitudinal axis of drive shaft 13. Power for rotating drive shaft 13 is transferred from an external power source (not shown) to drive shaft 13 via electromagnetic clutch 60, which is disposed about sleeve portion 151 of annular plate member 15 through a bearing 19.

A fixed scroll 20 is disposed within inner chamber 100 of cup-shaped casing 1 1, and is fixedly secured to the closed rear end portion of cup-shaped casing 11 by a plurality of bolts 111. Fixed scroll 20 comprises a circular end plate 21 and a spiral element or wrap 22, integrally formed therewith and extending axially from the forward end surface of circular end plate 21. Circular end plate 21 divides inner chamber 100 into suction chamber 40, located forward of circular end plate 21, and discharge chamber 50, located to the rear of circular end plate 21.

Circular end plate 21 comprises a circular groove 200 formed in the circumferential surface thereof. A seal ring 201 is disposed in groove 200 to seal the region between the peripheral surface of circular end plate 21 and the inner surface of peripheral side wall 115 of cup-shaped casing 11. This arrangement effectively isolates discharge chamber 50 from suction chamber 40. A hole or discharge port 21*a* is formed through circular end plate 21 at a central location, i e., at a position near the center of spiral element 22. Hole 21*a* links a central fluid pocket 400*b* (discussed below) to discharge chamber 50.

An orbiting scroll 30 is disposed in suction chamber 40 and comprises a circular end plate 31 and spiral element or wrap 32, integrally formed therewith and extending from the rear end surface of circular end plate 31. Spiral element 32 of orbiting scroll 30 interfits with spiral element 22 of fixed scroll 20 at an angular offset of 180°, and at a predetermined radial offset, to form at least one pair of sealed-off fluid pockets 400 therebetween.

A groove 221 is formed at an axial end surface of spiral element 22 of fixed scroll 20 substantially along the entire length thereof A seal element 22*a* is fittedly disposed in groove 221 along the entire length thereof Seal element 22*a* in groove 221 is sealingly in contact with the rear end surface of circular end plate 31 of orbiting scroll 30 during operation of the compressor. Similarly, a groove 321 is formed at an axial end surface of spiral element 32 of orbiting scroll 30 substantially along the entire length thereof. A seal element 32*a* is fittedly disposed in groove 321 along the entire length thereof Seal element 32*a* in groove 321 is sealingly in contact with the front end surface of circular end plate 21 of fixed scroll 20 during operation of the compressor.

A rotation preventing/thrust bearing device 70 is disposed within inner chamber 100 and prevents orbiting scroll 30 from rotating when drive shaft 13 rotates.

Orbiting scroll 30 further comprises an annular boss 33, which axially projects from the forward end surface of circular end plate 31 at a central location, opposite spiral element 32. A bushing 80 is disposed within a bearing 81 in a hollow space 331 defined by boss 33. Orbiting scroll 30 is supported on bushing 80 through boss 33 and bearing 81, such that bushing 80 may rotate with respect to orbiting scroll 30. An axial hole 82 is formed in bushing 80, at a position offset from the longitudinal axis of bushing 80. Drive pin 132, rearwardly projecting from the inner axial end surface of disk-shaped rotor 131, is fittedly and rotatably disposed in axial hole 82. Thus, orbiting scroll 30 is ultimately supported on drive pin 132 by bushing 80. When drive shaft 13 rotates, drive pin 132 orbits about the longitudinal axis of drive shaft 13. Bushing 80 both rotates with respect to its longitudinal axis, and orbits about the longitudinal axis of drive shaft 13, causing orbiting scroll 30 to undergo orbital motion with respect to the longitudinal axis of drive shaft 13. Although bushing 80 may rotate within boss 33, rotation of orbiting scroll 30 is prevented by rotation preventing mechanism 70.

In operation, rotation of drive shaft 13 causes a corresponding orbital motion of orbiting scroll 30 about the longitudinal axis of drive shaft 13. The plurality of line contacts formed between spiral elements 22 and 32 shift towards the center of the spiral elements. The plurality of pairs of fluid pockets 400 defined by the line contacts between spiral elements 22 and 32 follow each other toward the center of the spiral elements 22 and 32, and undergo a corresponding reduction in volume. A pair of fluid pockets

400 approach the center of spiral elements 22 and 32 and merge with each other to form a single, central fluid pocket 400*b*. Therefore, fluid or refrigerant gas introduced into suction chamber 40 from an external refrigerant circuit through inlet port 41 is taken into outer fluid pockets 400*a*, and is compressed inwardly towards the single central fluid pocket 400*b* of spiral elements 22 and 32. The compressed fluid in the single central fluid pocket 400*b* is discharged into discharge chamber 50 through hole 21*a*. The compressed fluid is further discharged to the external fluid circuit from discharge chamber 50 through outlet port 51.

In the scroll-type refrigerant fluid compressor described above, it is necessary to lubricate the frictional contacting surfaces between bushing 80 and bearing 81 and the internal frictional contacting surfaces of the bearing 81. In response to this requirement, a single, straight passageway 34 is formed in orbiting scroll 30 as a lubricating oil supply path. One end of passageway 34 is open to an outer side wall surface of an outer region of spiral element 32 of orbiting scroll 30, adjacent to the rear end surface of circular end plate 31 of orbiting scroll 30. The other end is open to an inner peripheral side surface of boss 33, adjacent to the front end surface of circular end plate 31 of orbiting scroll 30. Accordingly, passageway 34 is formed to link one of the outer sealed-off fluid pockets 400*a* with hollow space 331 of boss 33 in fluid communication during operation of the compressor. By passageway 34, the refrigerant gas and the mists of the lubricating oil suspended in the refrigerant gas in the outer sealed-off fluid pocket 400*a* are conducted into hollow space 331 of boss 33 by virtue of the pressure difference therebetween during operation of the compressor. The lubricating oil conducted into hollow space 331 of boss 33 flows through the small air gaps created between bushing 80 and bearing 81 and the interior of the bearing 81. Thus, the frictional contacting surfaces between bushing 80 and bearing 81 and the internal frictional contacting surfaces of the bearing 81 are lubricated.

Nevertheless, according to this known embodiment, passageway 34 must be inclined with respect to the longitudinal axis of circular end plate 31 of orbiting scroll 30. Therefore, a complicated manufacturing process is required when passageway 34 is formed through circular end plate 31 of orbiting scroll 30.

FIGS. 2 and 3 illustrate scroll type refrigerant fluid compressors in accordance with two other prior art embodiments. In FIGS. 2 and 3, the same reference numerals are used to denote identical elements of the compressor shown in FIG. 1. Consequently, further explanation thereof is omitted. Additionally, the right side of either FIG. 2 or 3 is referred to as a rear or a rearward end, and the left side of either FIG. 2 or 3 is referred to as a front or a forward end.

With reference to FIG. 2, a lubricating oil supply path 341 is formed in circular end plate 31 of orbiting scroll 30. Lubricating oil supply path 341 comprises a radial passageway 341*a* and a first and a second axial passageways 341*b* and 341*c*, which are formed perpendicular to radial passageway 341*a*. One end of radial passageway 341*a* is linked to one end of first axial passageway 341*b*, and the other end is open to an outer peripheral surface of circular end plate 31 of orbiting scroll 30. The other end of first axial passageway 341*b* is open to a central region of the front end surface of circular end plate 31 of orbiting scroll 30 within annular boss 33. One end of second axial passageway 341*c* is open to the rear end surface of circular end plate 31 of orbiting scroll 30, adjacent to an outer side wall surface of an outer region of spiral element 32 of orbiting scroll 30. The other end is linked to radial passageway 341*a* at a generally intermediate location thereof. A plug member 341*d* is plugged into the second end of radial passageway 341*a*, which is open to the outer peripheral surface of circular end plate 31 of orbiting scroll 30. As a result, lubricating oil supply path 341 links one of the outer sealed-off fluid pockets 400*a* with hollow space 331 of boss 33 in fluid communication during operation of the compressor.

However, in this known embodiment, when lubricating oil supply path 341 is fabricated, a process of separately forming three passageways 341*a*, 341*b* and 341*c*, and a subsequent process of plugging the plug member 341*d* into the second end of radial passageway 341*a* must be carried out. This results in a complicated manufacturing process of lubricating oil supply path 341.

With reference to FIG. 3, an axial passageway 342 is formed through a central region of circular end plate 31 of orbiting scroll 30 as a lubricating oil supply path. One end of axial passageway 342 is open to a central region of the rear end surface of circular end plate 31 of orbiting scroll 30. The other end is open to a central region of the front end surface of circular end plate 31 of orbiting scroll 30 within annular boss 33. As a result, axial passageway 342 links the single, central fluid pocket 400*b* with hollow space 331 of boss 33 in fluid communication during operation of the compressor.

An orifice tube 342*a* is fixedly disposed in axial passageway 342 so as to cause a throttling effect when the refrigerant gas flows therethrough from single, central fluid pocket 400*b* to hollow space 331 of boss 33 during operation of the compressor. Alternatively, axial passageway 342 may be formed as a very fine hole to have a throttling effect by itself.

In operation of the compressor illustrated in FIG. 3, the refrigerant gas and the mists of the lubricating oil suspended in the refrigerant gas in single, central fluid pocket 400*b* are conducted into hollow space 331 of boss 33 by virtue of the pressure difference therebetween. When the refrigerant gas flows through axial passageway 342 from single, central fluid pocket 400*b* to hollow space 331 of boss 33, the refrigerant gas turns from a gas under high pressure into a gas under low pressure by virtue of the throttling effect of axial passageway 342. The lubricating oil conducted into hollow space 331 of boss 33 flows through the small air gaps created between bushing 80 and bearing 81 and the interior of the bearing 81. Thus, the frictional contacting surfaces between bushing 80 and bearing 81 and the internal frictional contacting surfaces of bearing 81 are lubricated.

However, in this known embodiment, a high level of skill is required to either carry out a process of fixedly disposing orifice tube 342*a* within axial passageway 342 or to form axial passageway 342 as a very fine hole through circular end plate 31 of orbiting scroll 30.

SUMMARY OF THE INVENTION

Therefore, it is an object of the present invention to provide a simply and easily constructed lubricating mechanism for lubricating the region in which an orbiting scroll and an inner end of a drive shaft are operatively connected to each other.

According to the present invention, a scroll-type refrigerant fluid compressor comprises a housing; a fixed scroll having a first circular end plate, from which a first spiral wrap extends fixedly disposed within the housing; and an orbiting scroll having a second circular end plate, from which a second spiral wrap extends.

The first and second spiral wraps interfit at an angular and radial offset to form a plurality of line contacts defining at least one pair of sealed-off fluid pockets. An anti-wear plate having a spiral configuration is disposed on a first axial end surface of the second circular end plate of the orbiting scroll and engages with the second spiral element of the orbiting scroll. Thus, direct contact between the first axial end surface of the second circular end plate of the orbiting scroll and the axial end surface of the first spiral wrap of the fixed scroll is prevented.

The compressor also comprises a drive shaft rotatably supported by the housing. The compressor further comprises a coupling means for operatively coupling an inner end of the drive shaft to the orbiting scroll such that the orbiting scroll orbits and thereby changes the volume of at least one pair of fluid pockets. The compressor further comprises a rotation preventing means for preventing the rotation of the orbiting scroll during orbital motion.

The coupling means comprises an annular boss extending from a central portion of a second axial end surface of the second circular end plate of the orbiting scroll, opposite to the first axial end surface. The coupling means further comprises a bushing operatively connected to the inner end of the drive shaft and rotatably disposed within the boss.

A hole having a first end, and a second end opposite to the first end, is axially formed through the second circular end plate of the orbiting scroll. The first end of the hole is open to the second axial end surface of the second circular end plate of the orbiting scroll at a position within the annular boss. The second end of the hole is open to a central portion of the first axial end surface of the second circular end plate of the orbiting scroll.

Other objects, features, and advantages of this invention will be understood from the following detailed description of the preferred embodiments with reference to the attached drawings.

BRIEF DESCRIPTION OF THE DRAWINGS

In FIG. 5, a relevant part of the scroll-type refrigerant fluid compressor in accordance with the first embodiment of the present invention is illustrated.

DETAILED DESCRIPTION OF PREFERRED EMBODIMENTS

Figure 1:
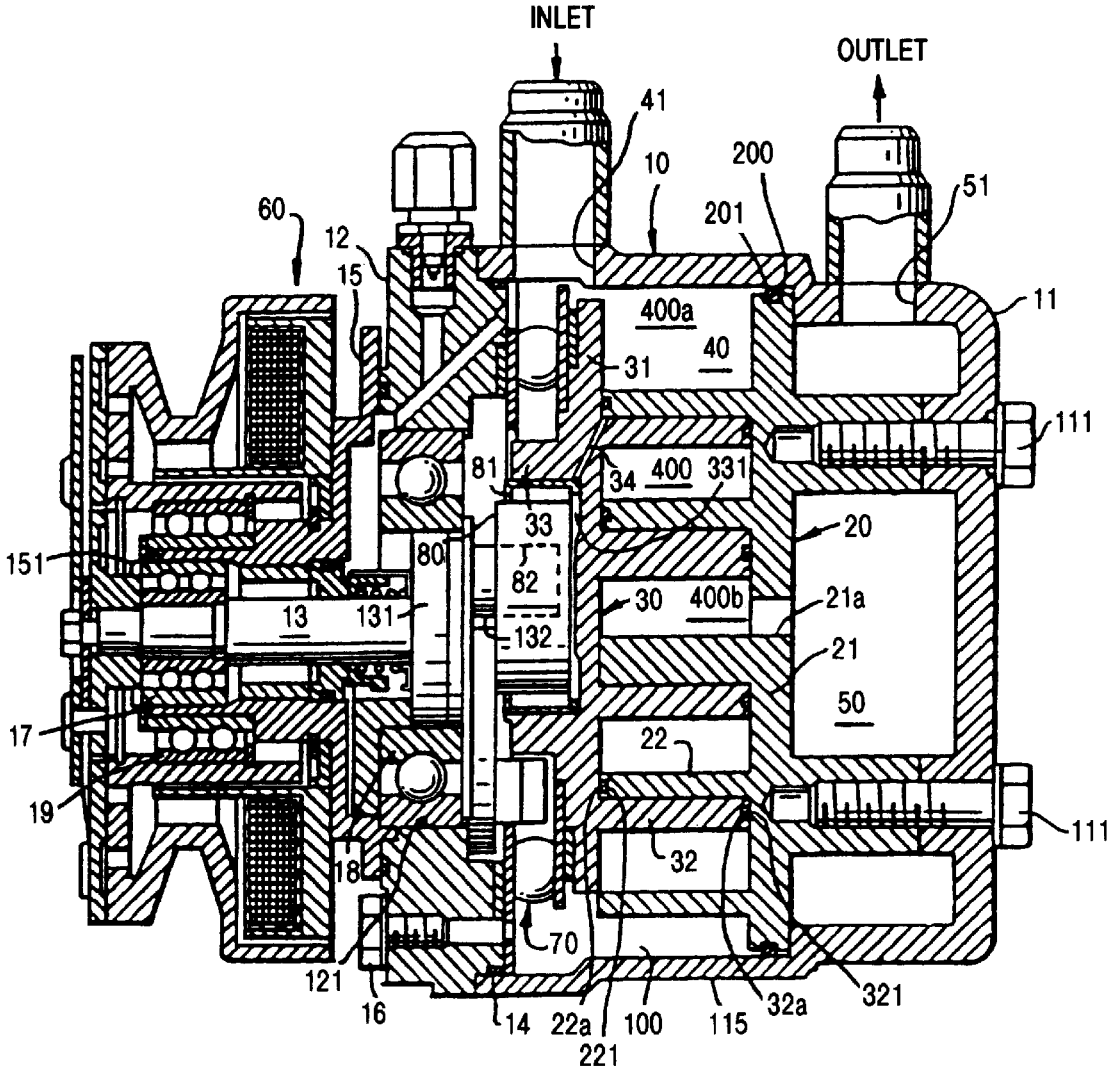
FIG. 1 PRIOR ART
FIG. 1 is a cross-sectional view of a scroll-type refrigerant fluid compressor in accordance with one known embodiment.
Figure 2:
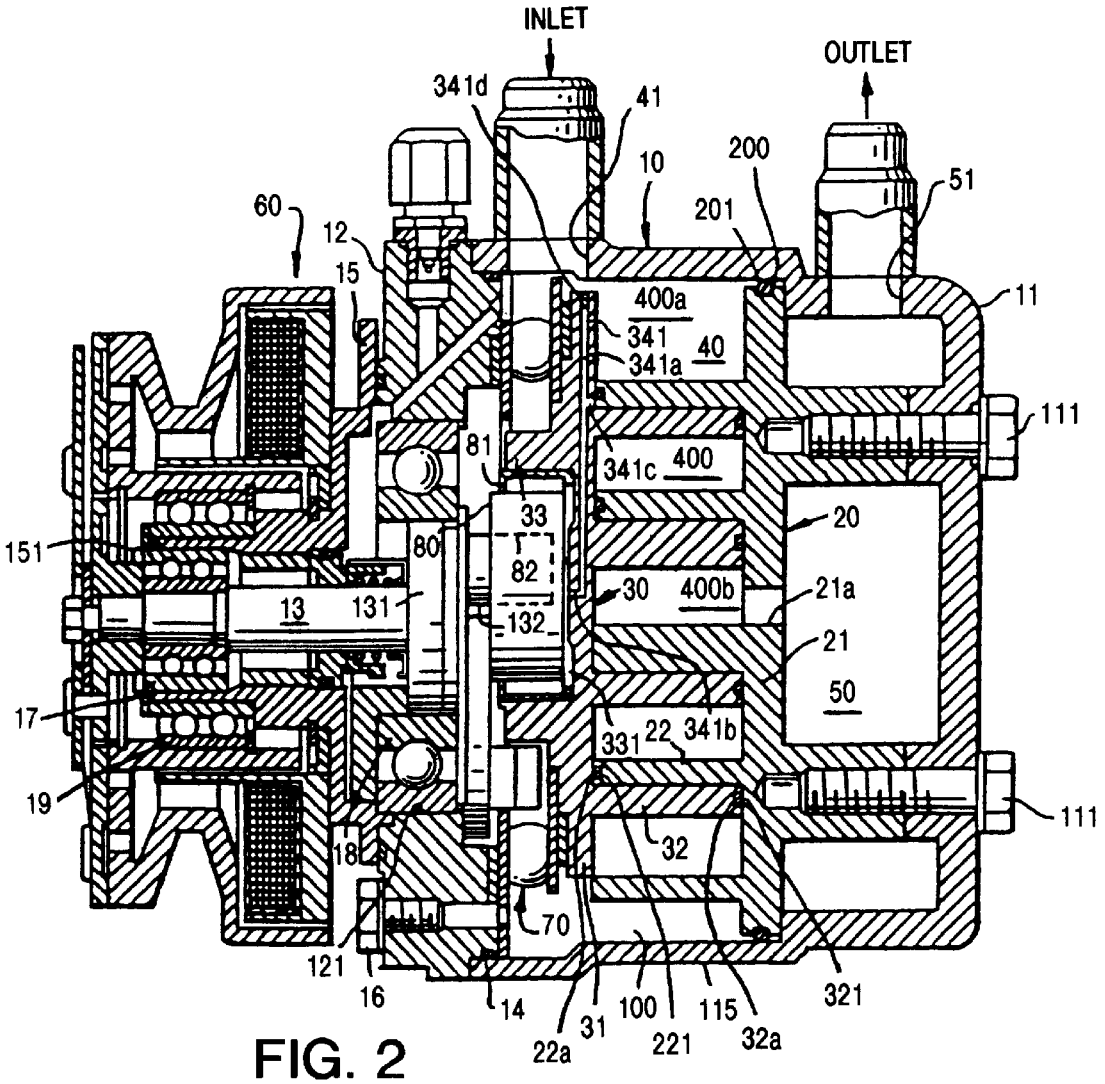
FIG. 2 PRIOR ART
FIG. 2 is a cross-sectional view of a scroll-type refrigerant fluid compressor in accordance with another known embodiment.
Figure 3:
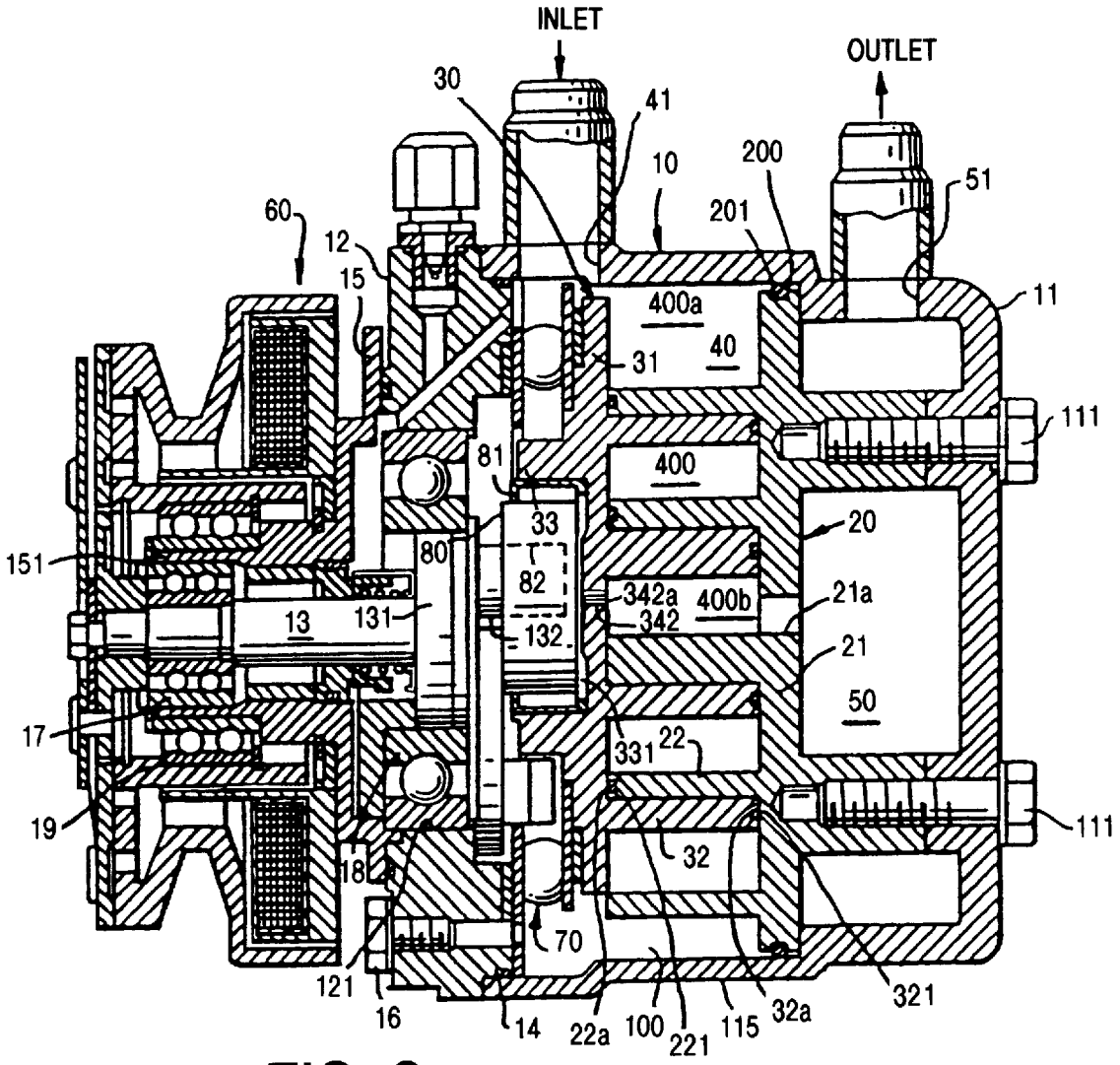
FIG. 3 PRIOR ART
FIG. 3 is a cross-sectional view of a scroll-type refrigerant fluid compressor in accordance with still another known embodiment.
Figure 4:
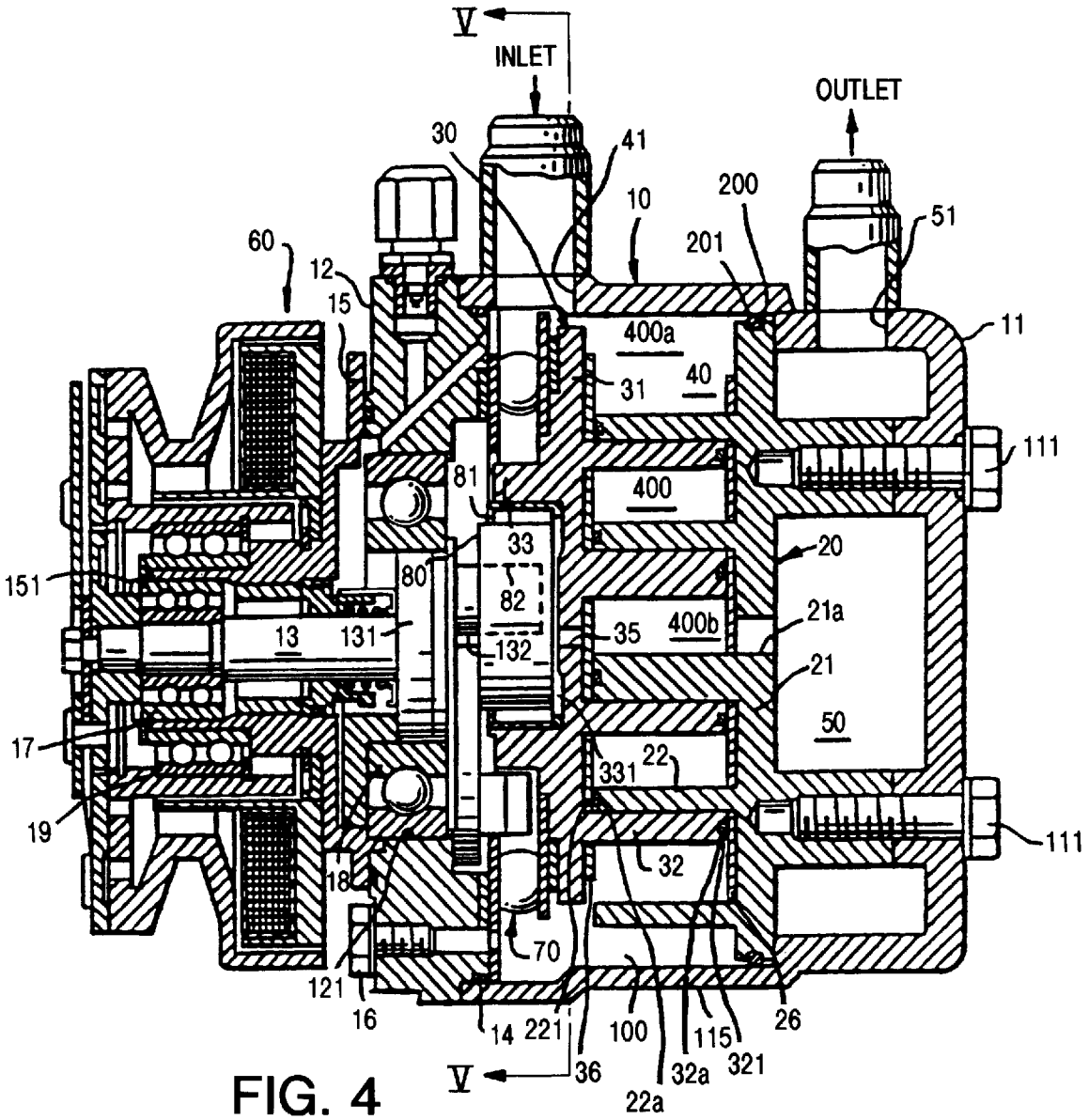
FIG. 4 is a cross-sectional view of a scroll-type refrigerant fluid compressor in accordance with a first embodiment of the present invention.

A scroll-type refrigerant fluid compressor in accordance with a first embodiment of the present invention is illustrated in FIG. 4. In FIG. 4, the same reference numerals are used to denote identical elements of the compressor shown in FIG. 1 and, thus, further explanation thereof is here omitted. Additionally, the right side of FIG. 4 is referenced as rear or a rearward end, and the left side of FIG. 4 is referenced as a front or a forward end. This reference notation is for the sake of convenience of description only, and does not limit the scope of the invention in any way.

With reference to FIG. 4, fixed and orbiting scrolls 20 and 30 may be made of aluminum alloy, and are arranged such that spiral element 32 of orbiting scroll 30 interfits with spiral element 22 of fixed scroll 20 at an angular offset of 180°, and at a predetermined radial offset, to form at least one pair of sealed-off fluid pockets 400 therebetween. The rear end surface of circular end plate 31 of orbiting scroll 30 is finished by a normal cutting operation to have a surface roughness Rz value within a range of about 5 to 10 $\mu$m, so that fine reticular indents 311 (FIG. 6) are created thereat.

Figure 5:
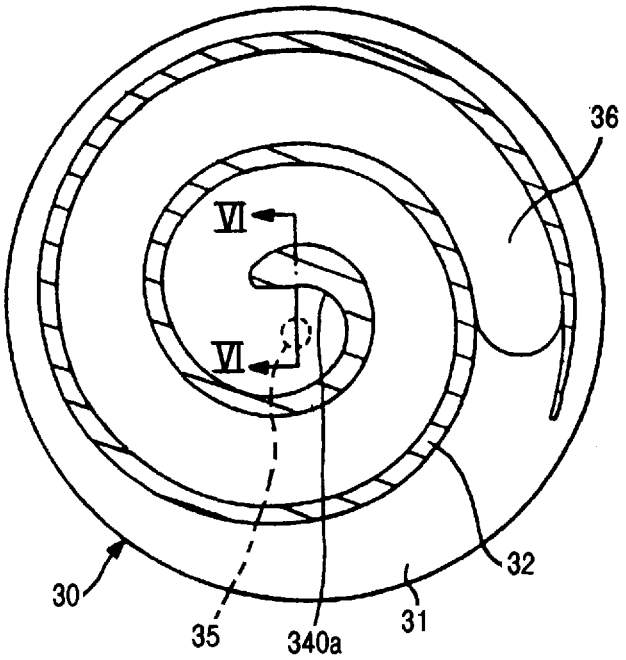
FIG. 5 is a cross-sectional view of an orbiting scroll, taken along line V—V of FIG. 4.

As illustrated in FIG. 5, anti-wear plate 36 having a spiral configuration is disposed on a portion of the rear end surface of circular end plate 31 of orbiting scroll 30 and engages with spiral element 32 of orbiting scroll 30. When anti-wear plate 36 is disposed on the portion of the rear end surface of circular end plate 31 of orbiting scroll 30, a small air gap 340*a* is created between spiral element 32 of orbiting scroll 30 and anti-wear plate 36 along the edge of anti-wear plate 36. Fine reticular indents 311 created at the rear end surface of circular end plate 31 of orbiting scroll 30 become fine reticular paths 340*b* beneath the anti-wear plate 36. Anti-wear plate 36 is made of, for example, steel, and is prepared to prevent the direct frictional contact between circular end plate 31 of orbiting scroll 30 and seal element 22*a* disposed in groove 221 of spiral element 22 of fixed scroll 20. Thus, abnormal abrasion of either seal element 22*a* or circular end plate 31, or both, is reduced or eliminated. Seal element 22*a* is made of wear resisting material, for example, Teflon wear resistant material, i.e., polytetrafluoroethylene. Seal element 22*a* in groove 221 is sealingly in contact with anti-wear plate 36 during operation of the compressor.

Similarly, referring to FIG. 4, anti-wear plate 26 having a spiral configuration is disposed on a portion of the front end surface of circular end plate 21 of fixed scroll 20 and engages with spiral element 22 of fixed scroll 20. This prevents direct frictional contact between circular end plate 21 of fixed scroll 20 and seal element 32*a* disposed in groove 321 of spiral element 32 of orbiting scroll 30. Thus, abnormal abrasion of either seal element 32*a* or circular end plate 22, or both, is reduced or eliminated as well. Seal element 32*a* is made of wear resisting material, for example, Teflon wear resistant material, i.e. polytetrafluoroethylene. Seal element 32*a* in groove 321 is sealingly in contact with anti-wear plate 26 during operation of the compressor.

Figure 6:
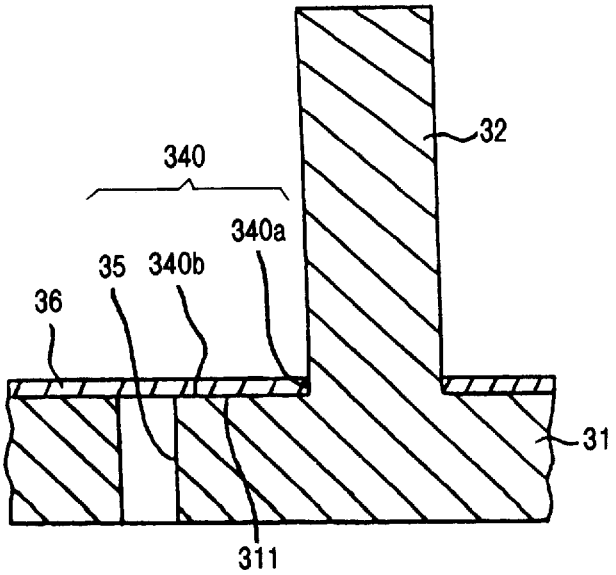
FIG. 6 is an enlarged, cross-sectional view taken along the line VI—VI of FIG. 5.

With reference to FIG. 6 in addition to FIG. 4, a circular hole 35 having a normal diameter is axially formed through a central region of circular end plate 31 of orbiting scroll 30 by a normal boring operation. One end of hole 35 is linked to a central region of fine reticular paths 340*b*, and the other end is linked to hollow space 331 of annular boss 33.

During operation of the compressor, a portion of the compressed refrigerant gas in the single central fluid pocket 400*b* flows into hollow space 331 of annular boss 33 by virtue of the pressure difference therebetween. The compressed refrigerant gas flows via an inner end portion of the small air gap 340*a* created between spiral element 32 of orbiting scroll 30 and anti-wear plate 36, the central region of fine reticular paths 340*b* beneath the anti-wear plate 36, and hole 35. Therefore, the inner end portion of the small air gap 340*a*, the central region of reticular paths 340*b*, and hole 35 form a passageway 340, which links the single central fluid pocket 400*b* to hollow space 331 of annular boss 33.

As part of the compressed refrigerant gas in the single central fluid pocket 400*b* flows into hollow space 331 of annular boss 33 through passageway 340, the refrigerant gas and the mists of the lubricating oil suspended in the compressed refrigerant gas in the single central fluid pocket 400*b* are conducted into hollow space 331 of boss 33. Accordingly, passageway 340 functions as a lubricating oil supply path. The lubricating oil conducted into hollow space 331 of boss 33 also flows through the air gaps created between bushing 80 and bearing 81 and the interior of the bearing 81. Thus, the frictional contacting surfaces between bushing 80 and bearing 81 and the internal frictional contacting surfaces of bearing 81 are effectively lubricated.

As described above, according to a first embodiment of the present invention, neither a complicated manufacturing process nor a high level of manufacturing skill is required to fabricate passageway 340.

In addition, when the compressed refrigerant gas flows from the single central fluid pocket 400*b* to hollow space 331 of annular boss 33 through passageway 340, the compressed refrigerant gas is throttled at the central region of fine reticular paths 340*b* beneath anti-wear plate 36. As a result, flow of the compressed refrigerant gas from single, central fluid pocket 400*b* to hollow space 331 of annular boss 33 is suppressed. Consequently, the percentage of the compressed refrigerant gas flowing from single, central fluid pocket 400*b* to hollow space 331 of annular boss 33 is of negligible value, and any decrease in the volumetric efficiency of the compressor also is negligible.

Figure 7:
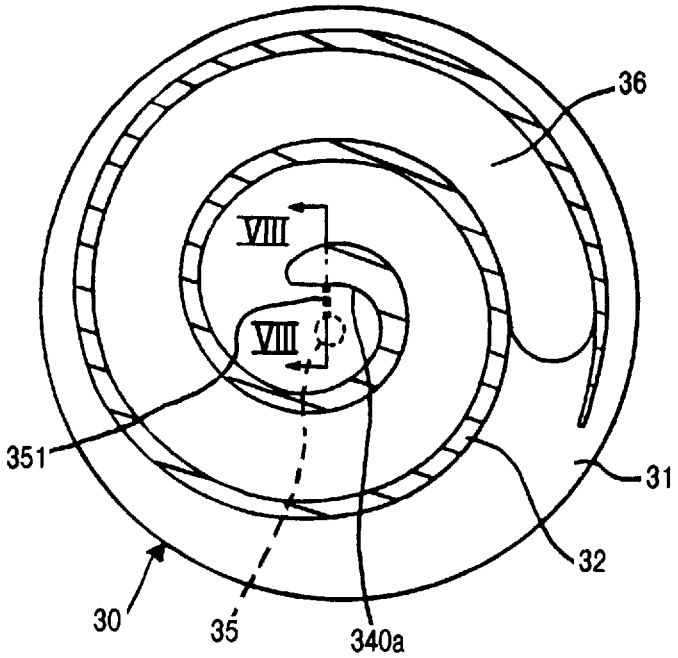
FIG. 7 is a cross-sectional view of an orbiting scroll of a scroll-type refrigerant fluid compressor in accordance with a second embodiment of the present invention.
Figure 8:
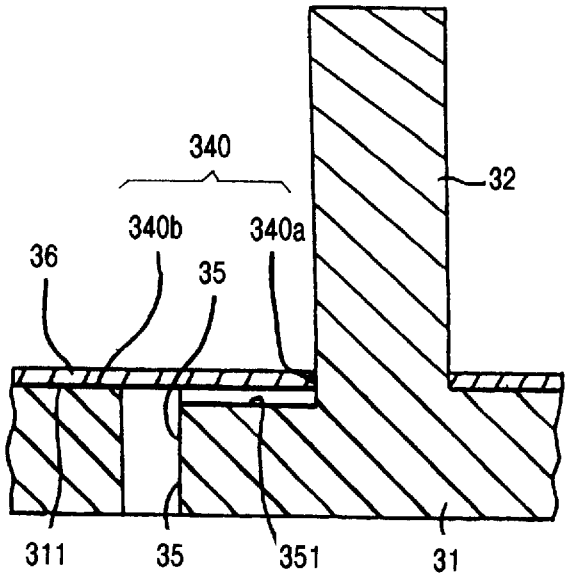
FIG. 8 is an enlarged, cross-sectional view taken along the line VIII—VIII of FIG. 7.

With reference to FIGS. 7 and 8, which illustrate relevant portions of a scroll-type refrigerant fluid compressor in accordance with a second embodiment of the present invention, a single, straight groove 351 is formed at the central region of the rear end surface of circular end plate 31 of orbiting scroll 30 by, for example, cutting. One end of groove 351 is linked to one end of hole 35, and the other end is linked to the inner end portion of small air gap 340*a* created between spiral element 32 of orbiting scroll 30 and anti-wear plate 36.

Figure 9:
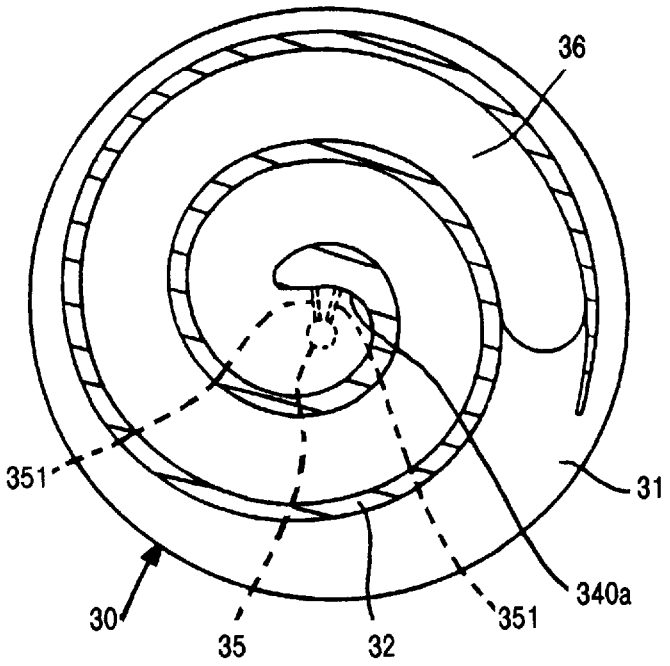
FIG. 9 is a cross-sectional view of an orbiting scroll of a scroll-type refrigerant fluid compressor, modified from the second embodiment of the present invention.

According to this embodiment, a portion of the lubricating oil passing through the central region of reticular paths 340*b* is gathered in single, straight groove 351, and is guided thereby to one end of hole 35. Therefore, the lubricating oil is more effectively conducted to hollow space 331 of boss 33 from single, central fluid pocket 400*b*. Furthermore, the flow rate of the lubricating oil from single, central fluid pocket 400*b* to hollow space 331 of boss 33 through passageway 340 may be selected by changing the width and depth of groove 351. Moreover, there may be a plurality of such grooves 351, as illustrated in FIG. 9. In FIG. 9, two straight grooves 351 are formed at the central region of the rear end surface of circular end plate 31 of orbiting scroll 30. Other effects and the mode of operation of the second embodiment are similar to those of the first embodiment, and further explanation thereof is here omitted.

Figure 10:
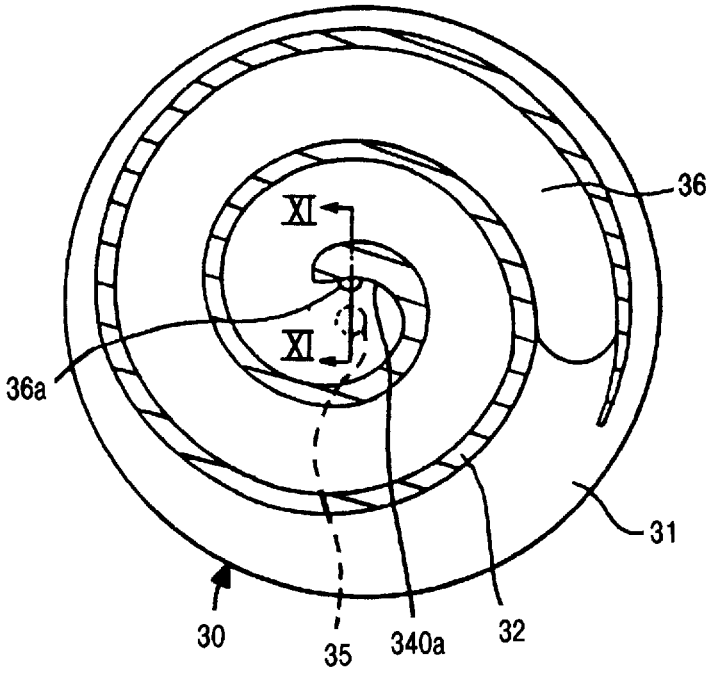
FIG. 10 is a cross-sectional view of an orbiting scroll of a scroll-type refrigerant fluid compressor in accordance with a third embodiment of the present invention.
Figure 11:
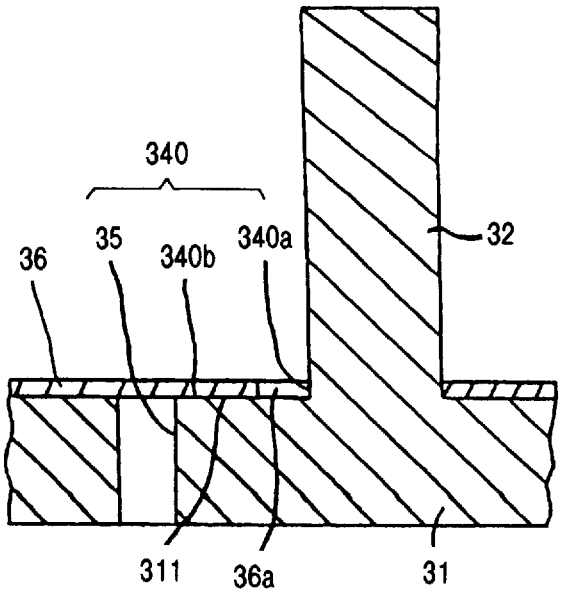
FIG. 11 is an enlarged, cross sectional view taken along the line XI—XI of FIG. 10.

With reference to FIGS. 10 and 11, illustrating a relevant part of a scroll type refrigerant fluid compressor in accordance with a third embodiment of the present invention, a semicircular, cut-out portion 36*a* is formed at the edge of the inner end portion of anti-wear plate 36 by, for example, press working.

Figure 12:
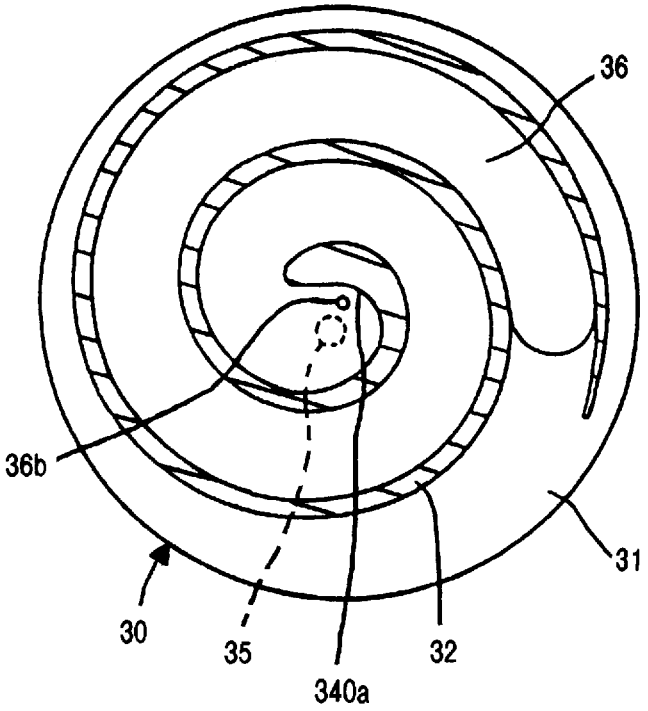
FIG. 12 is a cross-sectional view of an orbiting scroll of a scroll-type refrigerant fluid compressor, modified from the third embodiment of the present invention.

According to this embodiment, the magnitude of the throttling effect occurring at the central portion of fine reticular paths 340*b* beneath anti-wear plate 36 may be adjusted by changing the opening area of semicircular, cut-out portion 36*a*. Further, in place of semicircular, cut-out portion 36*a*, at least one circular, cut-out portion 36*b* may be formed at the inner end portion of anti-wear plate 36, as illustrated in FIG. 12. Other effects and the mode of operation of the third embodiment are similar to those of the first embodiment, and further explanation thereof is here omitted.

This invention has been described in connection with preferred embodiments. The embodiments disclosed herein, however, are provided by way of example only, and the invention is not restricted thereto. It will be understood by those skilled in the art that variations and modifications may be made within the scope of this invention, as defined by the following claims.

We claim:

1. A scroll-type refrigerant fluid compressor comprising:

a housing;

a fixed scroll fixedly disposed within said housing and having a first circular end plate from which a first spiral wrap extends;

an orbiting scroll having a second circular end plate from which a second spiral wrap extends, said first and second spiral wraps interfitting at an angular and radial offset to form a plurality of line contacts defining at least one pair of sealed-off fluid pockets;

a plate member having a spiral configuration disposed on a first axial end surface of said second circular end plate of said orbiting scroll engaging with said second spiral element of said orbiting scroll, so that direct contact between said first axial end surface of said second circular end plate of said orbiting scroll and an axial end surface of said first spiral wrap of said fixed scroll is prevented;

a drive shaft rotatably supported by said housing;

a rotation preventing means for preventing the rotation of said orbiting scroll during orbital motion; and a coupling means for operatively coupling an inner end of said drive shaft to said orbiting scroll, such that said orbiting scroll orbits to thereby change the volume of said at least one pair of sealed-off fluid pockets;

said coupling means including an annular boss extending from a central portion of a second axial end surface of said second circular end plate of said orbiting scroll opposite to said first axial end surface, and a bushing operatively connected to said inner end of said drive shaft and rotatably disposed within said boss;

wherein a hole having a first end and a second end opposite to said first end is axially formed through said second circular end plate of said orbiting scroll, wherein said first end of said hole is open to said second axial end surface of said second circular end plate of said orbiting scroll at a position within said annular boss, said second end of said hole is open to a central portion of said first axial end surface of said second circular end plate of said orbiting scroll, and wherein said plate member overlies said second end of said hole, and a restricted flow path is formed between said plate member and said first axial end surface.

2. The scroll-type refrigerant fluid compressor of claim 1, wherein at least one groove is formed at a central portion of said first axial end surface of said second circular end plate of said orbiting scroll, and wherein a first end of said at least one groove terminates at a periphery of said first end of said hole, and a second end of said at least one groove terminates at a side wall of an inner end portion of the second spiral wrap of said orbiting scroll.

3. The scroll-type refrigerant fluid compressor of claim 1, wherein a cut-out portion is formed at an edge of said plate member at a position adjacent to a side wall of an inner end portion of the second spiral wrap of said orbiting scroll.

4. The scroll-type refrigerant fluid compressor of claim 3, wherein said cut-out portion is semicircular.

5. The scroll-type refrigerant fluid compressor of claim 1, wherein at least one hole is formed through said plate member within an area at which a central fluid pocket is defined.

6. The scroll-type refrigerant fluid compressor of claim 1, wherein said first axial end surface of said second circular end plate of the orbiting scroll has a surface roughness of which the Rz value is within a range of about 5 to 10 $\mu$m.

7. The scroll-type refrigerant fluid compressor of claim 6, wherein fine reticular paths are formed between said plate member and said first axial end surface.

8. The scroll-type refrigerant fluid compressor of claim 1, wherein said orbiting scroll is made of aluminum alloy.

9. The scroll-type refrigerant fluid compressor of claim 8, wherein a seal element is disposed in a groove formed at said axial end surface of said first spiral wrap of said fixed scroll.

10. The scroll-type refrigerant fluid compressor of claim 9, wherein said seal element is made of polytetrafluoroethylene.

11. The scroll-type refrigerant fluid compressor of claim 10, wherein said plate member is made of steel.

* * * * *